US005222414A

United States Patent [19]

Kobayashi

[11] Patent Number: 5,222,414

[45] Date of Patent: Jun. 29, 1993

[54] ELECTRIC REMOTE CONTROL SYSTEM

[75] Inventor: Kiyonobu Kobayashi, Hamamatsu, Japan

[73] Assignee: Sanshin Kogyo Kabushiki Kaisha, Hamamatsu, Japan

[21] Appl. No.: 832,435

[22] Filed: Feb. 7, 1992

[30] Foreign Application Priority Data

Feb. 8, 1991 [JP] Japan ..... 3-39074

[51] Int. Cl.[5] ..... B63H 21/22; G05G 5/06

[52] U.S. Cl. ..... 74/527; 74/491; 74/531

[58] Field of Search ..... 74/531, 527, 491, 10 A, 74/10 R; 338/120

[56] References Cited

U.S. PATENT DOCUMENTS 2,571,028 10/1951 Gerry ..... 74/527
3,127,786 4/1964 Wooley ..... 74/527
3,789,694 2/1974 Haupt ..... 74/491 X
4,438,660 3/1984 Kittle ..... 74/531
4,552,031 11/1985 Barbagli ..... 74/491 X
4,622,861 11/1986 Hill ..... 74/10 R X

*Primary Examiner*—Richard M. Lorence
*Assistant Examiner*—Khoi Q. Ta
*Attorney, Agent, or Firm*—Ernest A. Beutler

[57] ABSTRACT

A remote control system for controlling the actuation of a pair of control levers through a control unit and an actuator unit from a remote location by a moveable operator. The operator is attached to a drive plate for rotation when the operator is moved. A contact element is associated with the drive plate and is adapted to make contact with one or the other of a pair of friction plates after the operator is rotated through a predetermined angle from its upright position so that the frictional force between the contact element and the friction plate increases as the angle of rotation of the operator increases from the predetermined angle.

7 Claims, 2 Drawing Sheets

ELECTRIC REMOTE CONTROL SYSTEM

BACKGROUND OF THE INVENTION

This invention relates to an electric remote control system adapted for controlling one or more operating conditions of a marine propulsion unit, and more particularly to an improved remote control unit of such a system which includes a rotatable operator wherein the frictional force applied to the operator increases as the angle of rotation of the operator is increased beyond a preset angle from the neutral position.

One type of remote control system has been proposed which is employed on certain watercraft to actuate a throttle and/or transmission control lever on an associated marine propulsion unit. With this type of system, movement of an operator of the remote control unit results in an electrical signal being transmitted from the unit and which is used to control an actuator assembly that is mechanically connected to control lever(s) on the propulsion unit.

Because this type of electric remote control system does not require the use of a mechanical cable between the remote operator and the actuator assembly, the load that is normally imposed on the operator by the cable and the attached actuator assembly is eliminated thereby greatly reducing the overall load on the operator. A relatively light load on the operator is desireable in that it makes the shifting and/or throttle operation easier. However, it is necessary that the operator have some resistance to its rotation to insure proper operation. Therefore, it has usually been the practice in an electric remote control system to impose some load on the operator to provide this resistance and to insure proper operation. Typically, however, this applied load has been constant without regard to the degree of rotation of the operator and therefore without relation to the speed of the watercraft. As a result, movement of the operator tends to feel the same to the driver no matter what its position or how fast the watercraft is moving so that there is no operating feeling in the system. This tends to make operation of the watercraft somewhat uninteresting.

It is, therefore, a principal object of this invention to provide an improved electric remote control system for a marine propulsion unit which provides resistance against movement of a remote control operator that is related to the angle of rotation of the operator.

It is another object of this invention to provide an improved electric remote control system wherein the force required to move a remote operator of the system varies with the angular rotation of the operator to improve the operating feeling of the system.

SUMMARY OF THE INVENTION

A first feature of this invention is adapted to be embodied in a remote control unit for transmitting control movement from the unit to a controlled element through an electrical signal. The remote control unit comprises an operator including a drive plate having a contact element rotatable between a plurality of positions including a neutral position and at least one friction plate wherein the contact element makes contact with the friction plate after the operator is rotated through a preset angle from the neutral position such that the frictional force between the contact element and the friction plate increases as the angle of rotation of the operator increases from the preset angle.

A second feature of the invention is adapted to be embodied in a remote control system for transmitting control movement to a controlled element. The system comprises a control unit, an operator including a drive plate having a contact element rotatable between a plurality of positions including a neutral position, and a position detector associated with the operator for detecting the position of the operator and outputting a signal to the control unit indicative of the detected position of the operator. An actuator unit is provided for actuating the controlled element on the basis of a signal received from the control unit. The system further includes at least one friction plate wherein the contact element makes contact with the friction plate after the operator is rotated through a preset angle from the neutral position such that the frictional force between the contact element and the friction plate increases as the angle of rotation of the operator increases from the preset angle.

DETAILED DESCRIPTION OF THE PREFERRED EMBODIMENT OF THE INVENTION

Figure 1:
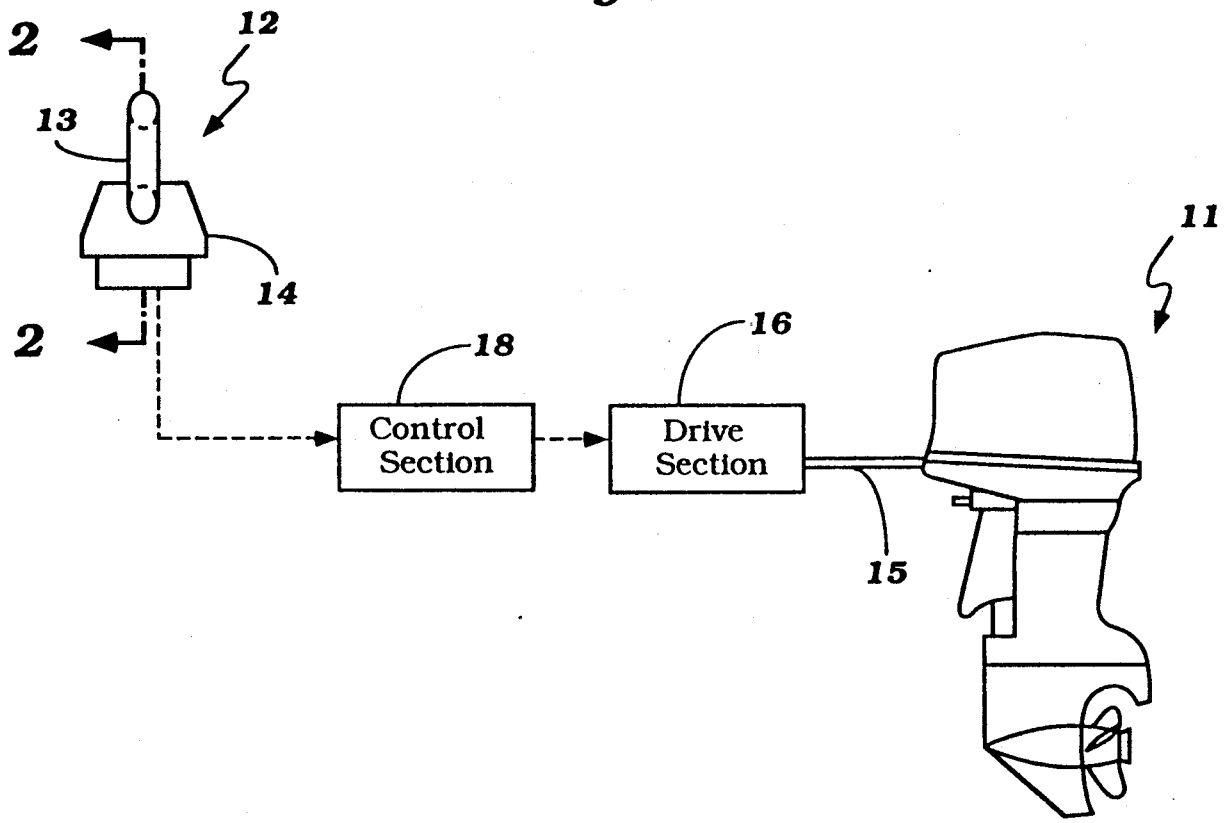
FIG. 1 is a side elevational view of a marine propulsion unit shown with an associated remote control system illustrated schematically and constructed and operated in accordance with an embodiment of the invention.

Referring first to FIG. 1, a remote control system for operating a marine propulsion unit, identified generally by the reference numeral 11, from a remote location is illustrated. The marine propulsion unit 11 includes an internal combustion engine and may comprise either an outboard motor or the outboard drive portion of an inboard/outboard drive unit. A remote control unit, indicated generally by the reference numeral 12, is positioned at an appropriate location within an associated watercraft (not shown) and is provided for controlling the transmission and/or throttle of the marine propulsion unit 11.

A transmission and throttle control lever are positioned on the marine propulsion unit 11 and are respectively adapted to operate a conventional forward, neutral, reverse transmission of the type used with such propulsion units 11 and to control the speed of the powering internal combustion engine by controlling the throttle opening of the engine. In the illustrated embodiment, both of these control levers are actuated by the remote control unit 12.

The remote control unit 12 is comprised of an operator 13 which may be pivotally moved relative to a housing 14. In the illustrated embodiment, the operator 13 is selectively adapted to control both the transmission and throttle of the propulsion unit 11. To this end, the remote control unit 12 and system normally operates such that when the operator 13 is moved from the upright position forward about 30°, the transmission is shifted from neutral to forward, and when the operator 13 is moved from the upright position rearward about 30°, the transmission is shifted from neutral to reverse. When the operator 13 is pivoted within this range the throttle opening is kept relatively small. However, when the operator 13 is swung forward beyond 30°, the throttle opening is progressively increased while the transmission is maintained in forward. Similarly, when the operator 13 is pivoted rearward beyond 30°, the throttle opening is increased accordingly while the transmission is kept in reverse. It should be noted that the unit 12 may also be set for free throttle adjustment, such as for starting, wherein movement of the operator 13 forward from the upright position causes a corresponding increase in throttle opening while the transmission is maintained in neutral.

A cable 15 having a bowden wire extends between each of the throttle or transmission control levers and a drive section or unit, indicated by the reference numeral 16, which contains a pair of actuator units for actuation of the levers. Each of the actuator units comprises a slide rack which is slidably supported on a base and is operably connected to one end of the associated bowden wire. The other end of each bowden wire is connected to the transmission or throttle control lever on the marine propulsion unit 11. Each slide rack has teeth that are enmeshed with a pinion gear which is rotatably journaled upon a shaft. An electric motor is associated with each actuator unit and is coupled to the corresponding shaft through a reduction gear box assembly and is operated to drive the shaft and effect movement of the transmission or throttle control lever when the operator 13 is moved.

Figure 2:
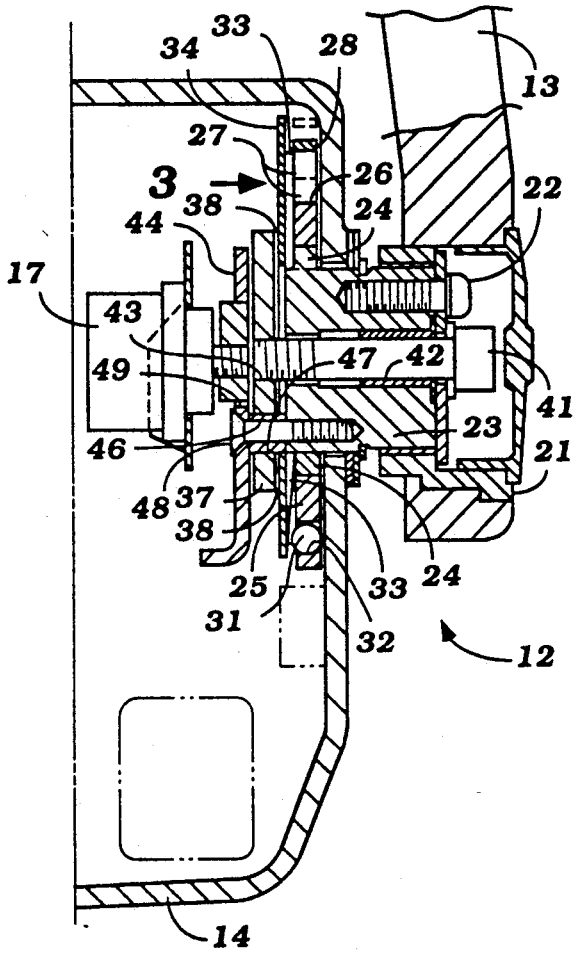
FIG. 2 is a cross sectional view of the remote control unit taken along line 2—2 in FIG. 1.

Referring now to FIG. 2, in addition to FIG. 1, a potentiometer 17, positioned within the housing 14 of the remote control unit 12 and operably connected to the operator 13 as will be described, detects the pivotal movement of the operator 13 and converts its rotation angle into an electrical signal which is transmitted through a signal wire to a control section or unit, indicated by the reference numeral 18. The control unit 18 includes a motor control circuit which outputs signals to the electric motors of the drive unit 16 for controlling their operation based on the content of the signal transmitted by the potentiometer 17. Each motor is selectively actuated to drive the corresponding shaft and pinion gear which, in turn, causes the associated slide rack to slide along its base to push or pull the corresponding bowden wire so as to effect movement of the transmission or throttle control lever.

Figure 3:
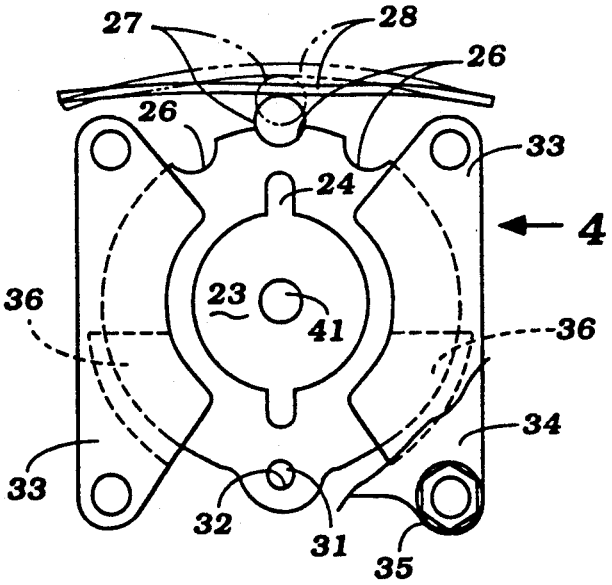
FIG. 3 is a side view of the inside of the remote control unit looking in the direction of the arrow in FIG. 2 and showing the friction plates.
Figure 4:
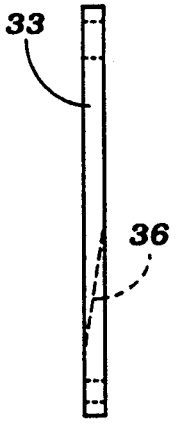
FIG. 4 is a view of one of the friction plates looking in the direction of the arrow in FIG. 3.

The construction and operation of the operator 13 will now be described with particular reference to FIGS. 3 and 4, in addition to FIG. 2. At the base of the operator 13 is a mounting portion 21 that is affixed by means of screws 22 to a rotating shaft 23 that is journaled for rotation within the housing 14. The rotating shaft 23 has formed on its inner end portion a pair of key portions 24 which couple the shaft 23 to a drive plate 25 so that it rotates with the shaft 23 and operator 13. Three (3) engaging grooves 26 which define the forward, neutral and reverse shift positions are formed on the upper edge of the drive plate 25. A roller element 27 is contained within the housing 14 and is urged downward by a plate spring 28 for selectively engaging one of the grooves 26 when the operator 13 and drive plate 25 are in the appropriate position to provide a click stop mechanism for the operator 13.

A contact element 31 in the form of a ball is retained in a retainer hole 32 that is formed through the lower portion of the drive plate 25. The contact ball 31 projects slightly out of hole 32 to create a frictional force on the operator 13 in a manner to be described. Projecting contact elements other than a ball may be used if the allowable pressure speed coefficient (Pv value) is low.

In accordance with the invention, a pair of friction plates 33, one for forward action of the operator 13 and the other for reverse action of the operator 13, are positioned against a mounting plate 34 that is affixed together with the friction plates 33 to the housing 14 by means of bolts and nuts 35. As shown in FIGS. 3 and 4, each of these friction plates 33 has a sloped portion 36 which increases in thickness in the upward direction.

In operation, the contact ball 31 moves as the operator 13 is moved and first makes contact with one of the friction plates 33 when the operator 13 first reaches the forward or reverse shift position (approximately 30° from upright) at which time the engaging roller 27 will be seated in either the forward or reverse engaging groove 26. As the operator 13 is moved further forward or further reverse, the frictional force between the contact ball 31 and the forward or reverse friction plate 3 increases as a result of the increasing thickness of the friction plates 33 in the upward direction. This means that the operating load of the operator 13 increases as the throttle opening of the engine and hence as the speed of the watercraft increases. In addition, the contact between the ball 31 and one of the friction plates 33 provides suitable friction to maintain the operator 13 at a desired forward or reverse position.

On the opposite side of the mounting plate 34 from the friction plates 33 is a moving plate 37 and a washer 38 interposed between the mounting plate 34 and the moving plate 37. The moving plate 37 and washer 38 are held in place by an adjusting bolt 41 which extends through an aperture 42 formed through the rotating shaft 23, through the center of the washer 38 and through a threaded hole 43 bored in the center of the moving plate 37. As a result of this connection, the moving plate 37 may be moved along the axis of the adjusting bolt 41 to adjust the frictional force between the contact ball 31 and friction plates 33 by turning the bolt 41. That is, by tightening the adjusting bolt 41, the moving plate 37, mounting plate 34 and friction plates 33 are moved as a unit to the right as seen from FIG. 2 to provide a greater frictional force between the contact ball 31 and the forward or reverse friction plate 33 at a given point when the operator 13 is moved beyond the 30° from upright position. On the other hand, when the adjusting bolt 41 is loosened from the tightened state, the moving plate 37 is moved to the left as seen from FIG. 2 to return the mounting plate 34 and the friction plates 33 to their original positions and therefore to lower the frictional force between the contact ball 31 and the forward or reverse friction plate 33 at a given point to its original state.

A stopper plate 44 is attached to the rotating shaft 23 by means of screws 45 which are received through spacer sleeves 46 that are fitted in corresponding holes 47 formed in the moving plate 37. The stopper plate 44 is securely fixed for rotation with the shaft 23 and serves to limit the maximum forward and reverse rotation of the operator 13 However, because the length of the spacer sleeves 46 is greater than the thickness of the moving plate 37, the tightening force of the screws 45 does not affect the position of the moving plate 37.

As shown in FIG. 2, the potentiometer 17 has a cylindrical portion that is fitted in a key-like connecting member 48 which is, in turn, received within in a hole 49 formed at the center of the stopper plate 44 for connecting the potentiometer 17 for rotation with the stopper plate 44. The potentiometer 17 converts the rotation of the stopper plate 44 and hence the rotating shaft 23 and operator 13 to an electrical signal which is transmitted to the control unit 18 for operation of the system as previously noted. Since the potentiometer 17 is disposed coaxially with the rotating shaft 23, the remote control unit 12 can be made compact.

From the foregoing description it should be readily apparent that a remote control system and unit have been illustrated and described which provides increased friction against movement of the operator as the angle of the operator is increased and hence as the speed of the watercraft is increased to provide a better operating feeling. The system also provides a mechanism for adjusting the friction imposed on the operator at a given forward or reverse operator position. Although an embodiment of the invention has been illustrated and described, various changes and modifications may be made without departing from the spirit and scope of the invention, as defined by the appended claims.

I claim:

1. A remote control unit for transmitting control movement from said unit to a controlled element through an electrical signal, comprising an operator including a drive plate having a contact element rotatable between a plurality of positions including a neutral position, and at least one friction plate having a sloped portion increasing the thickness of said friction plate in one direction, wherein said contact element makes contact with said friction plate after said operator is rotated through a preset angle from the neutral position such that the frictional force between said contact element and said friction plate increases as the angle of rotation of said operator increases from the preset angle and as said contact element moves along the sloped portion of said friction plate in the direction of increasing thickness.

2. A remote control unit as recited in claim 1, further comprising a pair of friction plates wherein said contact element makes contact with one friction plate after said operator is rotated through the preset angle in one direction and makes contact with the other friction plate after said operator is rotated through the preset angle in the other direction.

3. A remote control unit as recited in claim 1, further comprising an adjusting bolt for adjusting the frictional force between said contact element and said friction plate at a given operator angle greater than the preset angle.

4. A remote control unit as recited in claim 3, further comprising a moving plate moveable along the axis of said adjusting bolt for adjusting the frictional force between said contact element and said friction plate in response to adjustment of said adjusting bolt.

5. A remote control for transmitting control movement to a controlled element comprising a control unit, an operator including a drive plate having a contact element rotatable between a plurality of positions including a neutral position, a position detector associated with said operator for detecting the position of said operator and outputting a signal to said control unit indicative of the detected position of said operator, an actuator unit for actuating said controlled element on the basis of a signal received from said control unit, and at least one friction plate having a sloped portion increasing the thickness of said friction plate in one direction, wherein said contact element makes contact with said friction plate after said operator is rotated through a preset angle from the neutral position such that the frictional force between said contact element and said friction plate increases as the angle of rotation of said operator increases from the preset angle and as said contact element moves along the sloped portion of said friction plate in the direction of increasing thickness.

6. A remote control system as recited in claim 5, further comprising an adjusting bolt for adjusting the frictional force between said contact element and said friction plate at a given operator angle greater than the preset angle.

7. A remote control system as recited in claim 6, further comprising a moving plate moveable along the axis of said adjusting bolt for adjusting the frictional force between said contact element and said friction plate in response to adjustment of said adjusting bolt.

* * * * *